US007780103B2

(12) United States Patent
Häfner

(10) Patent No.: US 7,780,103 B2
(45) Date of Patent: Aug. 24, 2010

(54) METHOD FOR WINDING A SKEIN WINDABLE MATERIAL ONTO A SPOOL

(75) Inventor: Manfred Häfner, Leopoldshöhe (DE)

(73) Assignee: Hafner & Krullmann GmbH, Leopoldshohe (DE)

( * ) Notice: Subject to any disclaimer, the term of this patent is extended or adjusted under 35 U.S.C. 154(b) by 99 days.

(21) Appl. No.: 11/908,127

(22) PCT Filed: Mar. 8, 2006

(86) PCT No.: PCT/EP2006/002136

§ 371 (c)(1),
(2), (4) Date: Sep. 8, 2007

(87) PCT Pub. No.: WO2006/094788

PCT Pub. Date: Sep. 14, 2006

(65) Prior Publication Data

US 2008/0164366 A1 Jul. 10, 2008

(30) Foreign Application Priority Data

Mar. 10, 2005 (DE) ..... 10 2005 011 022

(51) Int. Cl.
*B65H 55/04* (2006.01)

(52) U.S. Cl. ..... 242/175; 242/176; 242/476.7; 242/613.2; 242/127

(58) Field of Classification Search ..... 242/174, 242/175, 176, 476.7, 127, 613–613.2, 129
See application file for complete search history.

(56) References Cited

U.S. PATENT DOCUMENTS

| | | | | |
|---|---|---|---|---|
| 1,819,337 A | | 8/1931 | Pevear | |
| 3,176,932 A | | 4/1965 | Kovaleski | |
| 3,970,268 A | * | 7/1976 | Sheetz | 242/609.2 |
| 4,580,399 A | | 4/1986 | Henrich | |
| 4,725,010 A | | 2/1988 | Lothamer | |
| RE33,240 E | * | 6/1990 | Lothamer | 242/480.7 |

FOREIGN PATENT DOCUMENTS

| | | | |
|---|---|---|---|
| BE | 1 000 634 A3 | | 2/1989 |
| DE | 38 44 964 C2 | | 2/1997 |
| EP | 0 029 971 A1 | | 6/1981 |
| EP | 0 241 964 A1 | | 10/1987 |
| EP | 0 672 016 A | | 9/1995 |
| JP | 03143872 A | * | 6/1991 |

* cited by examiner

*Primary Examiner*—John Q Nguyen
*Assistant Examiner*—William E Dondero
(74) *Attorney, Agent, or Firm*—Richard M. Goldberg

(57) ABSTRACT

A method for winding a skein-shaped windable product onto a spool formed of two spool halves (12, 14) which converge conically towards a middle radial plane (10) with two flange discs (16, 18) at the outer ends, includes the steps of rotating the spool about its central axis during the winding process, and feeding the windable product by a guide that moves along the length of the spool. There is further step of winding the windable product in layers substantially parallel to the lower conical surface up to the top conical surface, and the winding layers end respectively in a cylindrical surface connecting the circumference of the two flange discs (16, 18).

1 Claim, 3 Drawing Sheets

METHOD FOR WINDING A SKEIN WINDABLE MATERIAL ONTO A SPOOL

BACKGROUND OF THE INVENTION

The invention relates to a method for winding a skein-shaped windable product onto a spool consisting of two spool halves which converge conically towards a middle radial plane with two flange discs at the outer ends, the spool being rotated about its central axis during the winding process, and the windable product being fed by a guide that moves along the length of the spool.

There are many prior methods for winding a skein-shaped windable product onto spools. One example is DE 38 44 964 C2, which contains further references to the state of the art, such as EP 29 971 A1 or EP 241 964 A2. Also worth mentioning in this context is EP 672 016 B2. This document describes a spool with a conical winding core and two flange discs at the ends. At the least, the flange disc on the side of the smaller diameter can be removed from the winding core.

When designing spools of this type, and also the related winding method, practical reasons necessitate consideration of certain requirements, especially with regard to unwinding the windable product at the processing site. For example, the spools may be disposed in standing fashion during the unwinding process, in which case the windable product is unwound upwards. The spool does not rotate during this process. The windable product is first deflected through the top flange and fed to the region of the elongated central axis where it is connected to a guide device by means of which it is then unwound. The need to deflect the windable product through the top flange can cause heavy friction and may damage, or even break, the windable product. Care is therefore taken to ensure that the diameter of the upper portion of the winding core is as large as possible to minimise the deflection suffered by the windable product during unwinding. The rule is that the ratio of the flange diameter to the core diameter should not be greater than 2:1.

That is offset by the desire to achieve a high winding volume, which is facilitated by keeping the core diameter as small as possible.

Furthermore, it must be ensured that the process of unwinding the windable product can be interrupted without any risk of the windable product still on the core slipping downwards. This could, for example, happen with a winding core that tapers conically downwards, although on the other hand, this might be one way of meeting the requirement to ensure a portion with a large diameter at the upper end. The aforementioned EP 672 016 B2 therefore suggests a winding method which makes use of a standing winding core that tapers conically downwards, but wherein the windable product is deposited in inverted cone shape in layers built up from bottom to top.

This meets the two aforementioned requirements in that the upper end of the winding core has a large diameter, ensuring that the friction during the deflection of the windable product is acceptable, and, on the other hand, the windable product is prevented from slipping downwards if the unwinding process has to be interrupted. Spools of the type described also offer the possibility, once the flange on the side with the smaller diameter has been removed, of stacking the spools to save space whenever they are empty and have to be transported or stored. Spools of this type are associated with some disadvantages, however, resulting for example from the axial asymmetry, or from the fact that when made from plastic, tools of considerable size are required. Furthermore, two different parts are always required to make one spool, which naturally requires two injection moulding tools if the parts are made from plastic. One also has to have two different parts available for one spool. For these reasons, the preference is often for spools consisting of two spool halves or parts which converge from opposite directions towards the middle, upon which the present invention is based. Spools of this type can be separated along a central radial plane and the resultant spool parts are identical and can be stacked together.

SUMMARY OF THE INVENTION

The invention is based on the task of providing a method for winding material onto a spool, with a winding core which is contrived as a double cone converging to a radial centre plane, wherein the individual windings of the windable product neither slip downwards nor suffer excessive deflection at the edge of the top flange if the drum is to stand on one of the flanges, and therefore vertical with the axis of rotation.

To solve this task, the method according to the invention is characterised in that the windable product is wound in the form of layers substantially parallel to the lower conical surface up to a top conical surface, respectively, and in that the winding layers end, respectively, in a cylindrical surface connecting the circumference of the two flange discs.

The feature whereby the winding should be executed in the form of winding layers "substantially parallel" to the lower conical surface, merely means that the layers are wound in a regular cone. The winding cone can, however, be steeper or flatter than the cone of the lower winding section.

Outwardly, the winding layers are discontinued, respectively, and fed back to the start once the cylindrical surface connecting the two flange discs is reached.

A spool used according to the invention has many advantages. The contour line, which bends inwards towards the radial centre plane, means the requirements to be considered when unwinding upwards from a standing spool can be met using relatively simple winding technology. Particular advantages result when the spool is one which is divided into two identical halves along the radial centre plane, as said halves can be stacked on top of each other. In the case of spools which are divided in this fashion, the resultant stack is of relatively small dimensions and correspondingly manageable, and it may also be noted that the injection moulds required for the relatively small spool halves according to the present invention are less expensive to manufacture, thereby reducing total tool-related expenditure.

BRIEF DESCRIPTION OF THE DRAWINGS

Examples of preferred embodiments will be described in more detail below with reference to the attached drawings.

DETAILED DESCRIPTION

Figure 1:
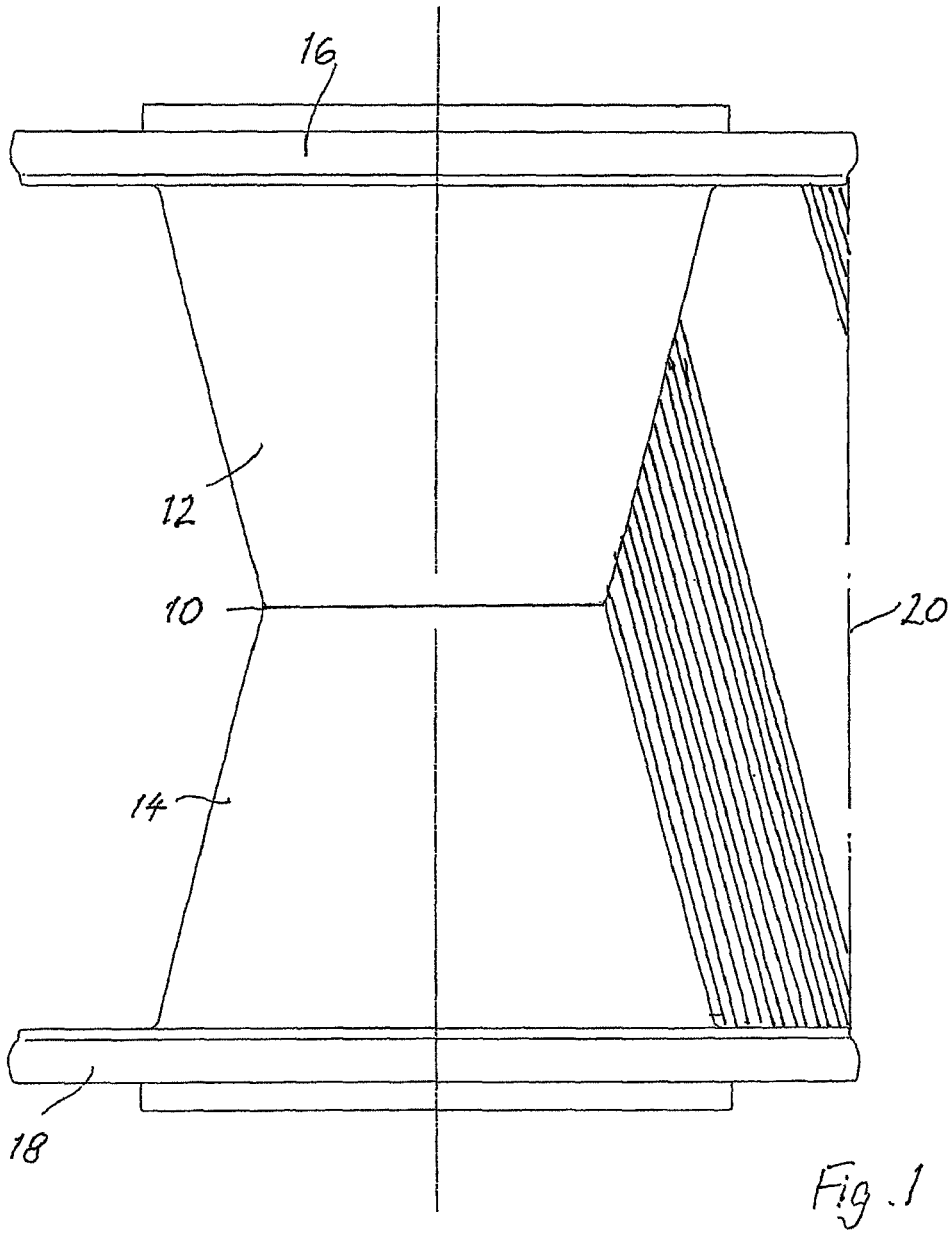
FIG. 1 is a diagrammatic view of a spool for the purpose of explaining a first embodiment of a winding method according to the invention.

FIG. 1 shows a spool comprising two conical spool halves 12, 14 which converge towards a middle radial plane 10, diverge outwardly in the fashion of a truncated cone shape and end in flange discs 16, 18.

In the first embodiment of FIG. 1, the individual winding layers are first deposited, working to and fro, on the lower winding core part. These layers each run between the inner surface of the lower flange disc 18 and the circumferential surface of the upper winding core part 12, as shown in FIG. 1. As processing continues, the individual layers end against an outer, cylindrical contour surface 20 connecting the two flange discs 16 and 18 essentially in their circumferential portion, and also against the inner surface of the upper flange disc 16. In all cases, the individual layers are continuously deposited in a to and fro fashion. This embodiment is relatively simple, and is therefore the preferred embodiment of those described below.

For this invention it is of no consequence whether the two conical spool parts are rigidly or detachably connected to each other in the region of the middle radial plane 10.

Figure 2:
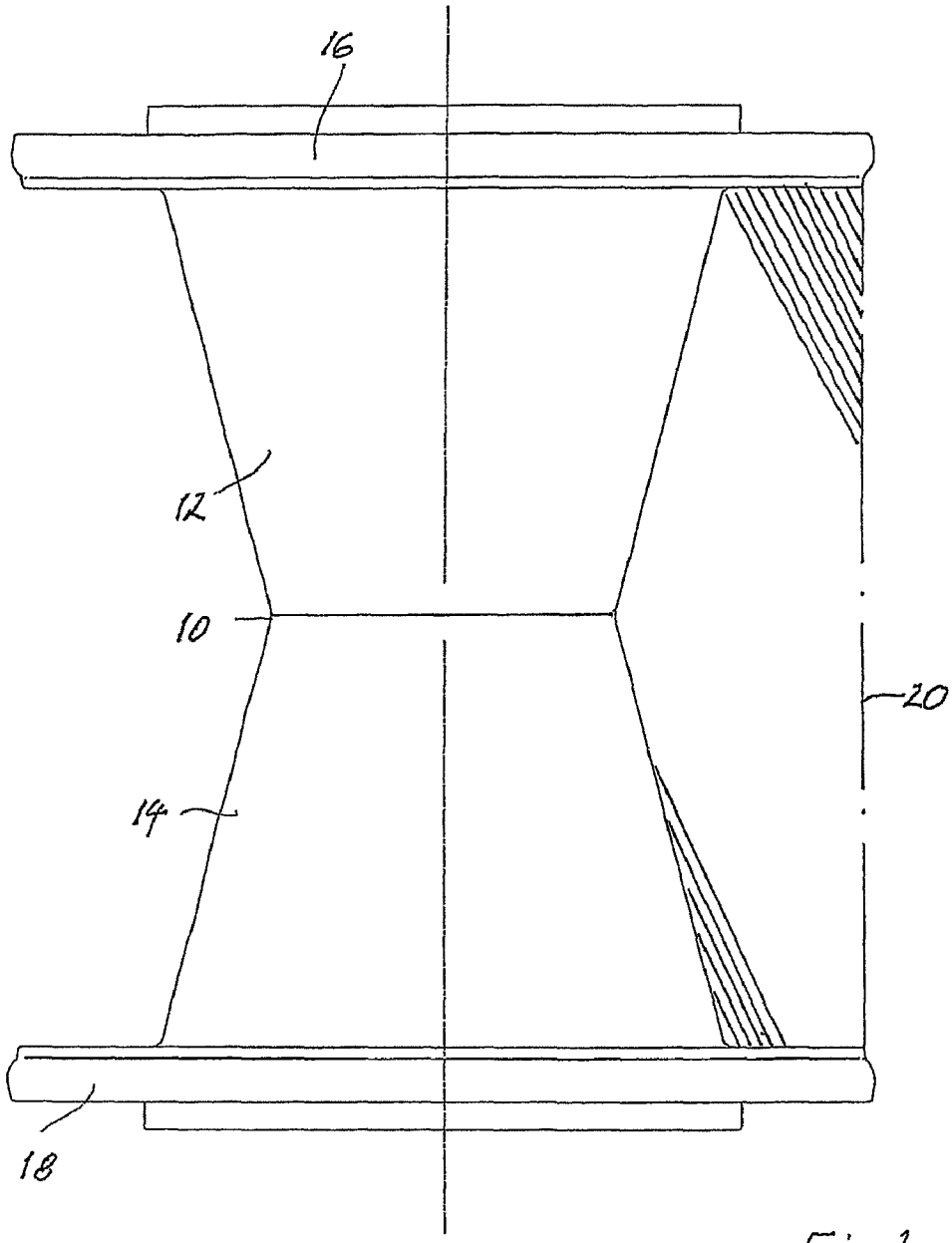
FIG. 2 is a corresponding view of a second embodiment.

To ensure successful results according to the invention it is not essential always to deposit the individual layers precisely parallel to the lower winding core part, that is to the conical surface thereof. FIG. 2 shows an embodiment where the individual layers of the windable product are deposited over cone surfaces having a greater taper angle than the taper angle of the lower winding core part 14. This means that initially, a number of shorter layers have to be deposited in the corner between the lower flange 18 and the lower winding core part 14, until the individual layers again fill out the entire length between the lower flange disc 18 and the upper winding core part 12. In this case, too, the individual winding layers are outwardly limited by the cylindrical contour surface 20 and upwardly by the lower surface of the upper flange disc 16.

Figure 3:
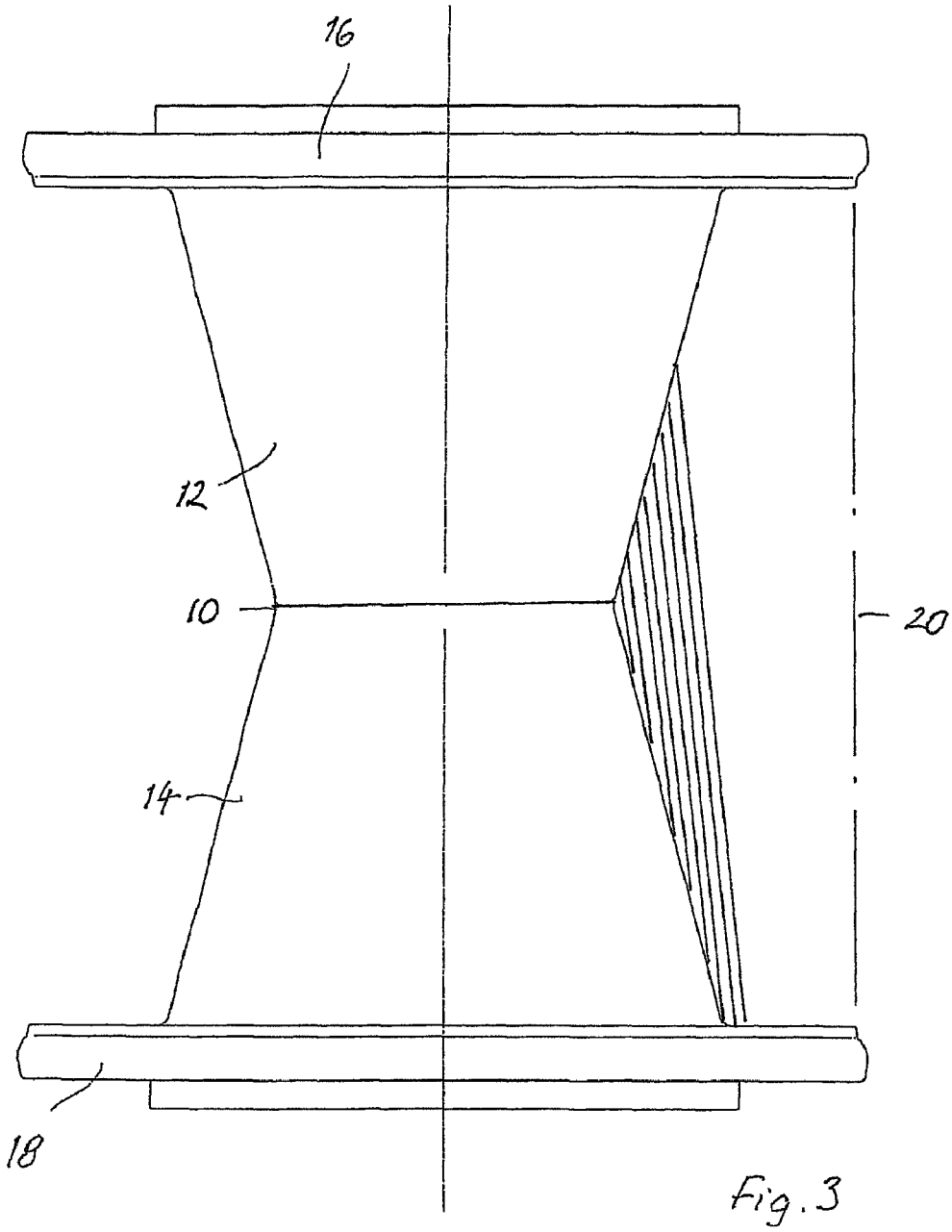
FIG. 3 is a corresponding view of a third embodiment.

FIG. 3 shows the opposite case to FIG. 2. In this case, the individual layers of the windable product follow a conus surface having a smaller taper angle than the taper angle of the lower winding core part 14. In this embodiment, layers have to be deposited from the region where the winding core is constricted bordering on the radial plane 10. The first layers end at the circumferential surfaces of the two winding core parts 12, 14 and finish against the inner surfaces of flange discs 16, 18 and the cylindrical contour surface 20.

If the cone angle of the winding layers is larger than the cone angle of the lower winding core part 14, there is less risk of the windable product slipping downwards when the spool is disposed in standing fashion.

What is claimed is:

1. A method for winding a skein-shaped windable product onto a spool comprised of two spool halves, one spool half having a top conical surface and the other spool half having a lower conical surface which converge conically to a middle radial plane with two flange discs at outer ends thereof, comprising the steps of:

rotating the spool about its central axis during a winding process, feeding the windable product by a guide that moves along the length of the spool, and winding the windable product in layers such that all layers on the spool are substantially parallel only to the lower conical surface up to the top conical surface of the spool, such that the winding layers end respectively in a cylindrical surface connecting the circumference of the two flange discs.

* * * * *